US010018046B2

(12) United States Patent
Nomura et al.

(10) Patent No.: US 10,018,046 B2
(45) Date of Patent: Jul. 10, 2018

(54) STEAM TURBINE

(71) Applicant: KABUSHIKI KAISHA TOSHIBA, Minato-ku (JP)

(72) Inventors: Daisuke Nomura, Kawasaki (JP); Akihiro Onoda, Yokohama (JP); Junichi Tominaga, Yokohama (JP); Shinichiro Ohashi, Ota-ku (JP)

(73) Assignee: KABUSHIKI KAISHA TOSHIBA, Minato-ku (JP)

( * ) Notice: Subject to any disclaimer, the term of this patent is extended or adjusted under 35 U.S.C. 154(b) by 629 days.

(21) Appl. No.: 14/191,820

(22) Filed: Feb. 27, 2014

(65) Prior Publication Data

US 2014/0271125 A1 Sep. 18, 2014

(30) Foreign Application Priority Data

Mar. 13, 2013 (JP) ..... 2013-050492

(51) Int. Cl.
*F01D 1/04* (2006.01)
*F01D 11/00* (2006.01)

(52) U.S. Cl.
CPC ..... *F01D 1/04* (2013.01); *F01D 11/001* (2013.01); *F01D 11/008* (2013.01); *F05D 2220/31* (2013.01); *F05D 2240/80* (2013.01)

(58) Field of Classification Search
CPC ..... F01D 11/001; F01D 11/04; F01D 5/082; F01D 5/085
USPC ..... 416/222
See application file for complete search history.

(56) References Cited

U.S. PATENT DOCUMENTS 3,291,447 A * 12/1966 Brandon ..... F01D 5/08 415/111
5,277,549 A * 1/1994 Chen ..... F01D 5/141 415/181
7,300,247 B2 * 11/2007 Nomura ..... F01D 9/02 415/191
2004/0086379 A1 5/2004 Farrell et al.
(Continued)

FOREIGN PATENT DOCUMENTS

EP 2 381 066 A1 10/2011
JP 53017802 A * 2/1978
(Continued)

OTHER PUBLICATIONS

Extended European Search Report dated May 19, 2014, in European Patent Application No. 14159450.7.

*Primary Examiner* — Justin Seabe
(74) *Attorney, Agent, or Firm* — Oblon, McClelland, Maier & Neustadt, L.L.P.

(57) ABSTRACT

A steam turbine 10 of an embodiment includes a turbine rotor 30, rotor blade cascades 41 having rotor blades 40, stationary blade cascades 53 having stationary blades 52, and a steam passage 60 formed on a turbine stage, among turbine stages, including the rotor blades each having a blade height equal to or more than a blade height at which a loss generated when a leakage steam flown between a diaphragm inner ring 51 and the turbine rotor 30 jets into a main steam and a benefit brought by increasing the blade height of each of the rotor blades 40 in accordance with an increase in a flow rate of the main steam by an amount of the leakage steam are cancelled, and leading the leakage steam from an upstream side to a downstream side of a rotor disk 31.

8 Claims, 18 Drawing Sheets

(56) References Cited

U.S. PATENT DOCUMENTS

| | | | | |
|---|---|---|---|---|
| 2010/0178155 | A1* | 7/2010 | Inomata | F01D 5/08 415/1 |
| 2011/0232285 | A1* | 9/2011 | Nowi | F01D 1/026 60/653 |
| 2011/0274536 | A1 | 11/2011 | Inomata et al. | |

FOREIGN PATENT DOCUMENTS

| | | |
|---|---|---|
| JP | 62-225701 | 10/1987 |
| JP | 11-303605 | 11/1999 |
| JP | 2001-200702 | 7/2001 |
| JP | 2006-125348 | 5/2006 |
| WO | WO 02/25066 A1 | 3/2002 |

* cited by examiner

STEAM TURBINE

CROSS-REFERENCE TO RELATED APPLICATION

This application is based upon and claims the benefit of priority from Japanese Patent Application No. 2013-050492, filed on Mar. 13, 2013; the entire contents of which are incorporated herein by reference.

FIELD

Embodiments described herein relate generally to a steam turbine.

BACKGROUND

In order to improve a power generating efficiency in a power generating plant, a steam turbine installed in the power generating plant is also required to improve efficiency. FIG. 17 is a view illustrating a part of meridian cross section of a conventional steam turbine 300.

FIG. 17 illustrates one turbine stage 310. This turbine stage 310 is configured by a stationary blade cascade 320 and a rotor blade cascade 330 positioned at an immediately downstream side of the stationary blade cascade 320. The stationary blade cascade 320 includes a plurality of stationary blades 323 supported with a predetermined interval therebetween in a circumferential direction between a diaphragm inner ring 321 and a diaphragm outer ring 322. The rotor blade cascade 330 includes a plurality of rotor blades 331 implanted, in a rotor disk 341 provided to a turbine rotor 340, with a predetermined interval therebetween in the circumferential direction.

In each turbine stage, a pressure P1 of steam 350 at an inlet of the stationary blades 323 is reduced since the steam passes through the stationary blades 323, and the pressure P1 becomes a pressure P2 at an outlet of the stationary blades 323. At this time, the steam 350 expands and increases its volume, and at the same time, a steam outflow direction is changed to a rotational direction of the turbine rotor 340, resulting in that the steam 350 has a velocity energy in the circumferential direction.

By a reaction force obtained when the direction of the steam 350 is changed to a counter-rotational direction by the rotor blades 331, and also by a reaction force obtained when the pressure is reduced to a pressure P3 so that the steam further expands and increases its outflow velocity, the velocity energy in the circumferential direction is converted into a rotational torque.

Here, it is structurally essential to provide a predetermined gap between a static part such as the diaphragm inner ring 321 and a rotating part such as the turbine rotor 340. For this reason, a leakage steam 351 whose flow is divided from the steam 350 passes through a gap 360 between the diaphragm inner ring 321 and the turbine rotor 340, as illustrated in FIG. 17. Concretely, the leakage steam 351 passes through the gap 360 between a sealing part 324 provided on an inside of the diaphragm inner ring 321 and the turbine rotor 340.

The leakage steam 351 does not flow through the stationary blade cascade 320, so that the leakage steam 351 on which the predetermined change in the direction is not performed is directly jetted from a portion between the diaphragm inner ring 321 and the rotor blades 331 toward a main flow to interfere with the main flow, which results in generating a loss.

A difference between the pressure P2 and the pressure P3 in front of and at the rear of the rotor blades 331 becomes a force that pushes the rotor disk 341 including the rotor blades 331 toward a turbine rotor axial direction. This force has a substantial magnitude in the entire steam turbine configured by multi-turbine stages. The force is normally cancelled by a thrust bearing with large diameter.

Among conventional steam turbines, one that includes a configuration different from that of the above-described steam turbine 300 has also been considered. FIG. 18 is a view illustrating a part of meridian cross section of a conventional steam turbine 301. Note that a component part same as that of the steam turbine 300 illustrated in FIG. 17 is denoted by the same reference numeral, and an overlapping explanation thereof will be omitted.

As illustrated in FIG. 18, there is formed, on the rotor disk 341 in the steam turbine 301, a steam passage 342 through which the leakage steam 351 is led from an upstream side to a downstream side of the rotor disk 341. With this configuration, a flow rate of the leakage steam 351 jetted from a portion between the diaphragm inner ring 321 and the rotor blades 331 toward a main flow is reduced. For this reason, a loss generated when the steam 351 is jetted toward the main flow is reduced. Further, a differential pressure (P2–P3) in front of and at the rear of the rotor blades 331 becomes small. For this reason, a force applied to the thrust bearing also becomes small, so that it is possible to reduce a diameter of the thrust bearing.

Here, FIG. 19 and FIG. 20 are views schematically illustrating secondary flow vortices generated on a root side of the rotor blades 331 in the conventional steam turbine 300. Note that FIG. 19 is a perspective view in which the vortex is seen from a trailing edge side of the rotor blades 331, and FIG. 20 is a plan view in which the vortices are seen from a tip side of the rotor blades 331.

Generally, a pressure between the rotor blades 331 becomes high on a pressure side 332 (pressure surface side), and it becomes low on a suction side 333 (suction surface side). Further, a driving force 370 of secondary flow vortex acts from a position with high pressure to a position with low pressure. Normally, a centrifugal force obtained when a steam flows between the rotor blades 331 while a direction thereof is changed acts so as to counter the driving force 370. Meanwhile, in the vicinity of an annular wall surface 334 on the root side, a flow velocity of the steam is significantly lowered due to a friction between the steam and the wall surface 334. Accordingly, the centrifugal force is lowered and cannot counter the driving force 370, resulting in that the secondary flow vortex is generated. The secondary flow vortex is classified into a horseshoe vortex 371 generated at a leading edge portion of the rotor blade 331 and developed along the suction side 333, and a passage vortex 372 developed while being drawn from the pressure side 332 toward the suction side 333 by the driving force 370. Both of the vortices sterically cross each other at a rear flow part of the suction side 333, and generate a large loss while curling up in a blade height direction.

As described above, when the steam passage 342 is not formed on the rotor disk 341 in the conventional steam turbine, there is generated the loss due to the interference of the steam 351 leaked between the diaphragm inner ring 321 and the turbine rotor 340 with the main flow. Further, the thrust bearing with large diameter is required to support the force generated due to the difference between the pressure P2 and the pressure P3 in front of and at the rear of the rotor blades 331, which increases manufacturing cost.

On the other hand, when the steam passage 342 is formed on the rotor disk 341 in the conventional steam turbine, it is possible to suppress the loss due to the interference described above, and to downsize the thrust bearing. However, the amount of steam that flows into the rotor blades is reduced, so that the blade height of each rotor blade set based on the flow rate of the steam becomes low. For this reason, the secondary flow vortex occupies a large area in the blade height direction, resulting in that the influence of loss caused by the secondary flow vortex becomes large.

DETAILED DESCRIPTION

Hereinafter, embodiments of the present invention will be described with reference to the drawings.

First Embodiment

Figure 1:
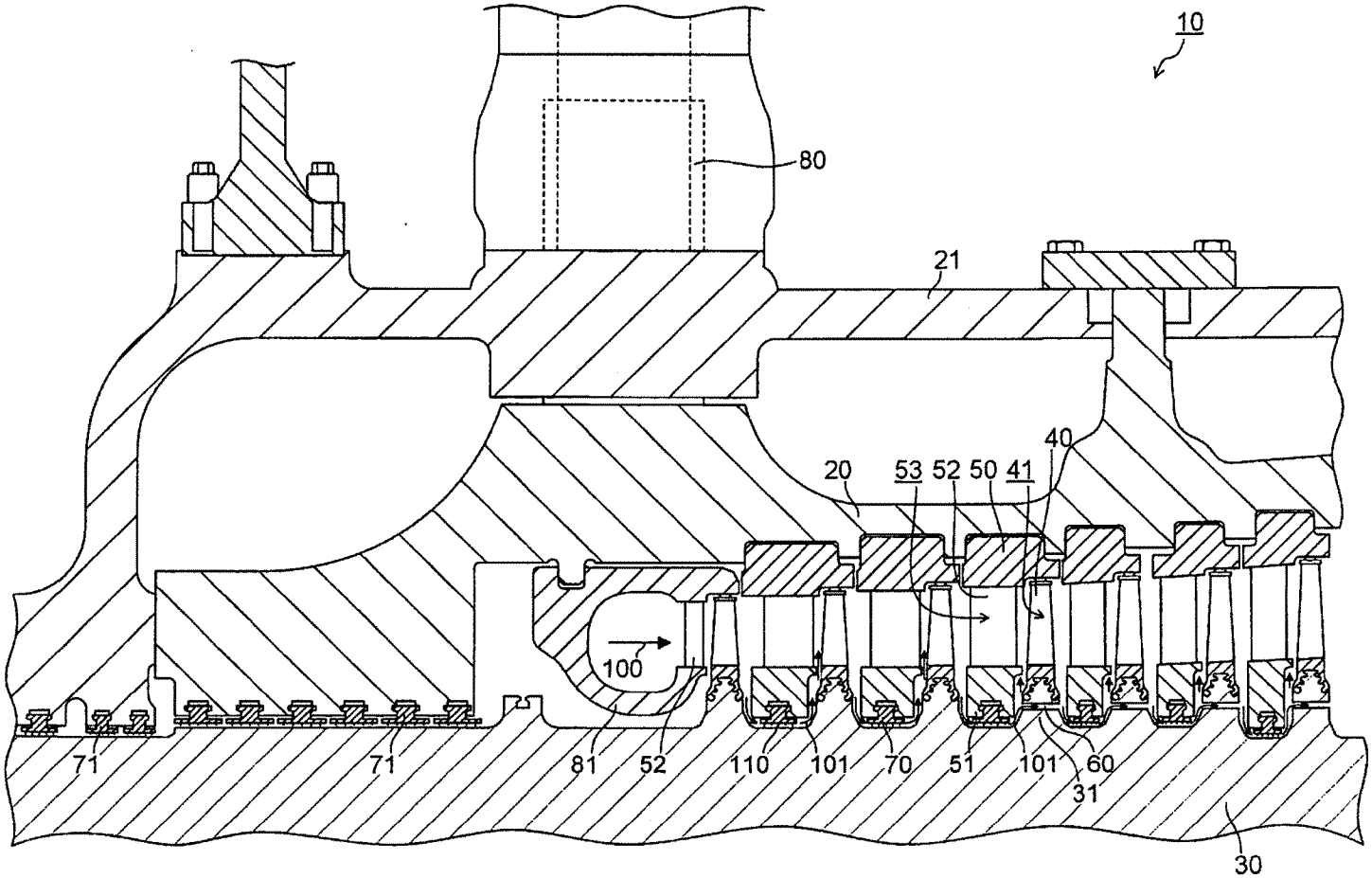
FIG. 1 is a view illustrating a meridian cross section of a steam turbine of a first embodiment.

FIG. 1 is a view illustrating a meridian cross section of a steam turbine 10 of a first embodiment. In the following description, the same component part is denoted by the same reference numeral, and an overlapping explanation thereof will be omitted or simplified. Here, a high-pressure turbine is exemplified as the steam turbine 10.

As illustrated in FIG. 1, the steam turbine 10 includes a double-structured casing composed of an inner casing 20 and an outer casing 21 provided outside the inner casing 20. A turbine rotor 30 is penetratingly provided in the inner casing 20.

The turbine rotor 30 includes, in a turbine rotor axial direction, a plurality of stages of rotor disks 31 projected to an outside in a radial direction along a circumferential direction. In each of the rotor disks 31, a plurality of rotor blades 40 inserted from the circumferential direction are implanted in the circumferential direction to form a rotor blade cascade 41.

In the inside of the inner casing 20, a diaphragm outer ring 50 is provided along the circumferential direction. In the inside of the diaphragm outer ring 50, a diaphragm inner ring 51 is provided along the circumferential direction.

A plurality of stationary blades 52 (nozzles) are supported in the circumferential direction between the diaphragm outer ring 50 and the diaphragm inner ring 51 to form a stationary blade cascade 53. The stationary blade cascade 53 is provided on an upstream side of each rotor blade cascade 41, and in the turbine rotor axial direction, a plurality of stages of alternately arranged stationary blade cascades 53 and rotor blade cascades 41 are provided. Further, the stationary blade cascade 53 and the rotor blade cascade 41 at an immediately downstream of the stationary blade cascade 53 form one turbine stage.

Although explanation will be made later in detail, on each of a predetermined turbine stage and a turbine stage on a downstream side of the predetermined turbine stage, there is formed a steam passage 60 through which a leakage steam 101 flown downstream between the diaphragm inner ring 51 and the turbine rotor 30 is led from an upstream side to a downstream side of the rotor disk 31.

On the diaphragm inner ring 51 on a side opposing the turbine rotor 30, a sealing part 70 is provided. With this configuration, the leakage of steam from a portion between the diaphragm inner ring 51 and the turbine rotor 30 to the downstream side is suppressed.

Further, in the steam turbine 10, a steam inlet pipe 80 is provided to penetrate through the outer casing 21 and the inner casing 20. An end portion of the steam inlet pipe 80 is connected to communicate with a nozzle box 81. Note that stationary blades 52 of a first stage are provided at an outlet of the nozzle box 81.

On an inside of the inner casing 20 and the outer casing 21 on an outside of a position at which the nozzle box 81 is provided (on an outside in a direction along the turbine rotor 30, and on a left side of the nozzle box 81 in FIG. 1), a plurality of gland sealing parts 71 are provided along the turbine rotor axial direction. With this configuration, the leakage of steam from portions between the inner casing 20, the outer casing 21 and the turbine rotor 30 to the outside is prevented.

Next, the steam passage 60 will be described in detail.

Figure 2:
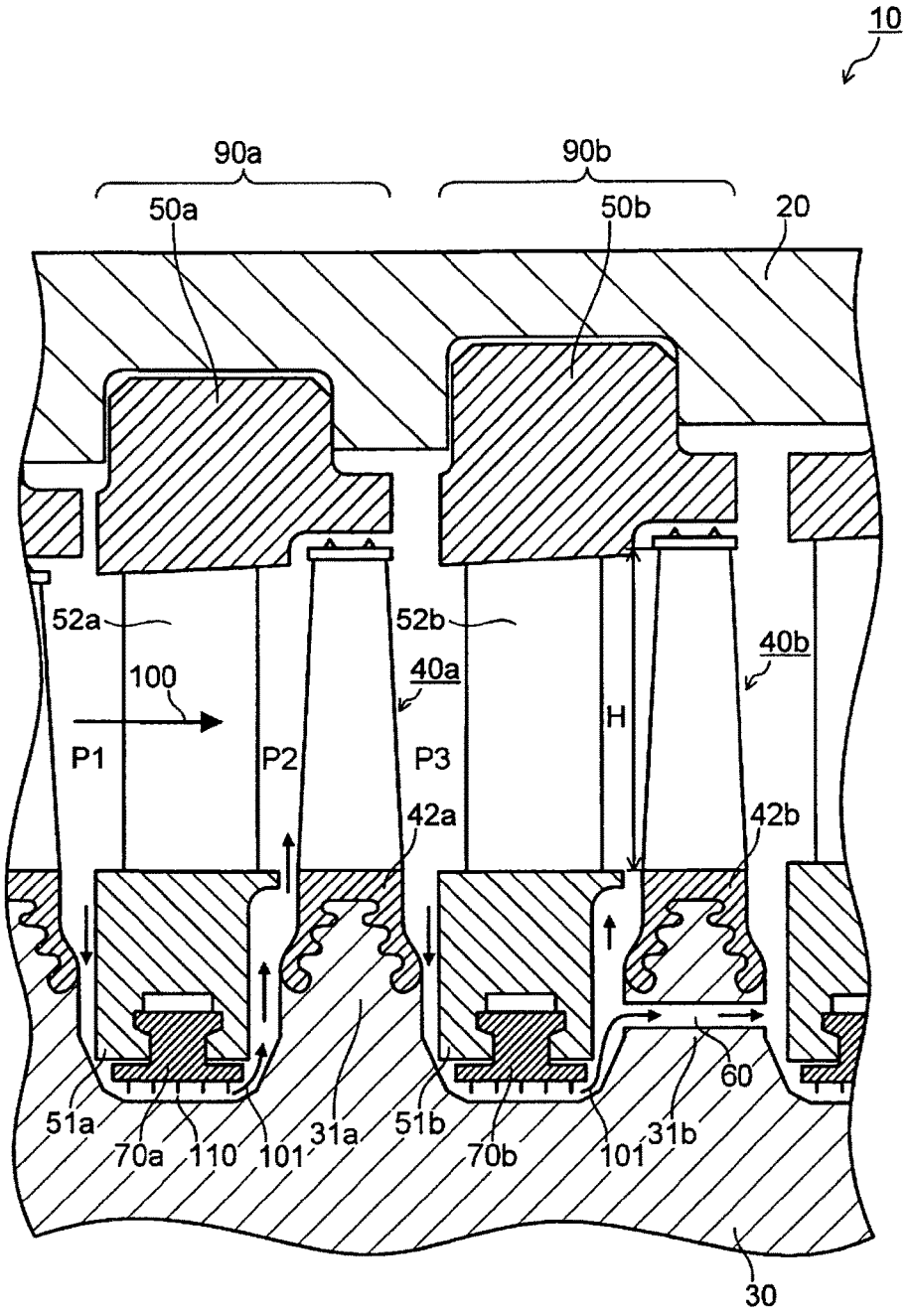
FIG. 2 is a view in which a part of the meridian cross section of the steam turbine of the first embodiment is enlarged.
Figure 3:
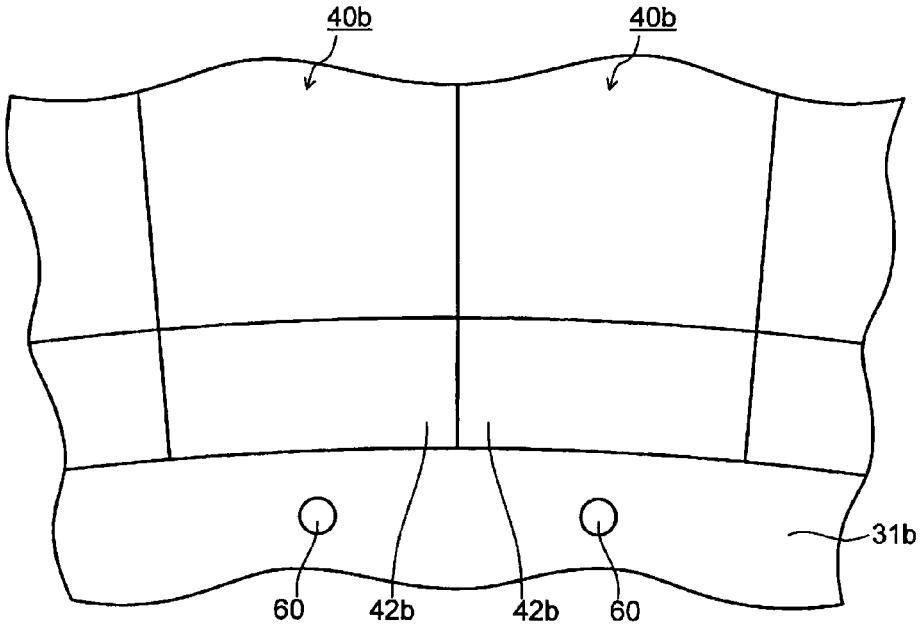
FIG. 3 is a plan view when a part of rotor disk and rotor blades of a turbine stage of the steam turbine of the first embodiment is seen from an upstream side.

FIG. 2 is a view in which a part of meridian cross section of the steam turbine 10 of the first embodiment is enlarged. FIG. 3 is a plan view when a part of rotor disk 31*b* and rotor blades 40*b* of a turbine stage 90*b* of the steam turbine 10 of the first embodiment is seen from an upstream side.

In FIG. 2, for the convenience of explanation, a turbine stage including no steam passage 60 is denoted by 90*a*, and a rotor blade, a rotor disk, a diaphragm outer ring, a diaphragm inner ring, a stationary blade, and a sealing part that form the turbine stage 90*a* are denoted by 40*a*, 31*a*, 50*a*, 51*a*, 52*a*, and 70*a*, respectively. Further, a turbine stage including the steam passage 60 is denoted by 90*b*, and a rotor blade, a rotor disk, a diaphragm outer ring, a diaphragm inner ring, a stationary blade, and a sealing part that form the turbine stage 90*b* are denoted by 40*b*, 31*b*, 50*b*, 51*b*, 52*b*, and 70*b*, respectively.

As illustrated in FIG. 2, on each of the turbine stage 90*b* and a turbine stage (not illustrated) at a downstream of the turbine stage 90*b*, the steam passage 60 is formed. On the other hand, on the turbine stage 90*a* at an upstream of the turbine stage 90*b*, the steam passage 60 is not formed. Note that also on a turbine stage at an upstream of the turbine stage 90*a* which is not illustrated in FIG. 2, the steam passage 60 is not formed.

As illustrated in FIG. 2 and FIG. 3, the steam passage 60 is configured by a through hole formed on the rotor disk 31*b*, for example. Note that the steam passage 60 is not limited to be configured by the through hole. The steam passage 60 is only required to have a configuration in which the leakage steam flown downstream between the diaphragm inner ring 51*b* (sealing part 70*b*) and the turbine rotor 30 is led from an upstream side to a downstream side of the rotor disk 31*b*.

Figure 4:
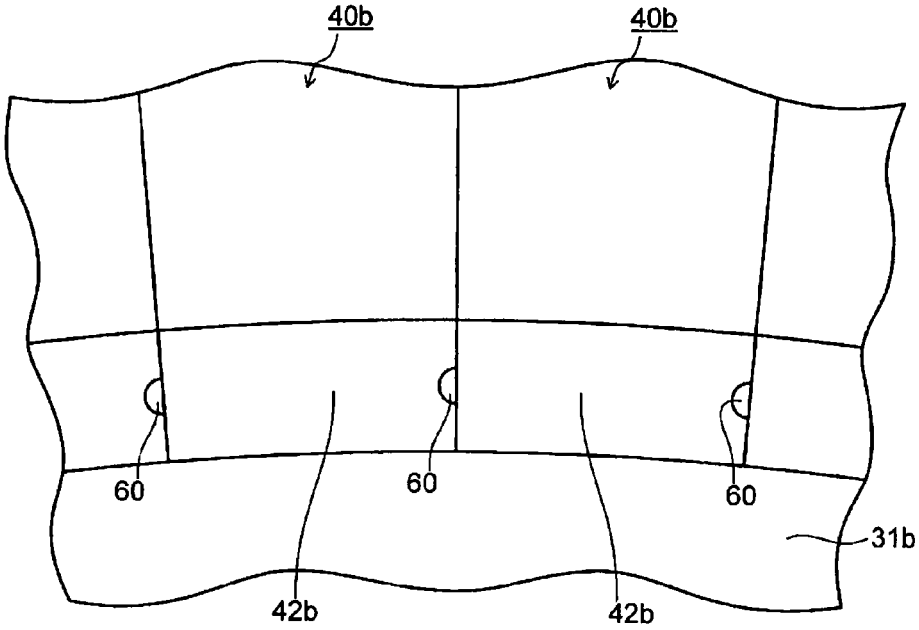
FIG. 4 is a plan view when a part of rotor disk and rotor blades provided with a steam passage of another configuration in the turbine stage of the steam turbine of the first embodiment is seen from the upstream side.

FIG. 4 is a plan view when a part of the rotor disk 31*b* and the rotor blades 40*b* provided with the steam passage 60 of another configuration in the turbine stage 90*b* of the steam turbine 10 of the first embodiment is seen from an upstream side. As illustrated in FIG. 4, the steam passage 60 may also be configured by a communication groove formed on one end face in the circumferential direction of each of implant parts 42*b* of the rotor blades 40*b* and extended from an upstream end to a downstream end of the implant parts 42*b*. Further, the communication groove may also be formed on both end faces in the circumferential direction of the implant parts 42*b* of the rotor blades 40*b*. In this case, it is also possible to make positions of the both communication grooves face each other to form one steam passage 60.

Note that in this case, although the steam passage 60 formed on the turbine stage 90*b* is described, the steam passage 60 with the same configuration is provided also on a turbine stage at a downstream of the turbine stage 90*b*.

Here, explanation will be made on a boundary between the turbine stage 90*a* including no steam passage 60 and the turbine stage 90*b* including the steam passage 60.

As illustrated in FIG. 2, in the turbine stage 90*a*, for example, a pressure P1 of steam (main steam) 100 at an inlet of the stationary blades 52*a* is reduced since the steam 100 passes through the stationary blades 52*a*, and the pressure P1 becomes a pressure P2 at an outlet of the stationary blades 52*a* (at an inlet of the rotor blades 40*a*). At this time, the steam 100 expands and increases its volume, and at the same time, an outflow direction thereof is changed to a rotational direction of the turbine rotor 30, resulting in that the steam 100 has a velocity energy in the circumferential direction.

By a reaction force obtained when the direction of the steam 100 is changed to a counter-rotational direction by the rotor blades 40*a*, and by a reaction force obtained when the pressure is reduced to P3 so that the steam further expands and increases its outflow velocity, the velocity energy in the circumferential direction is converted into a rotational torque. Accordingly, it becomes structurally essential to provide a gap 110 between a static part such as the diaphragm inner ring 51*a* and a rotating part such as the turbine rotor 30. Note that the above-described operation is also provided to another turbine stage 90*b* in the same manner.

By providing the gap 110 in the turbine stage 90*a* including no steam passage 60, a leakage steam 101 whose flow is divided from the steam 100 passes through the gap 110 between the diaphragm inner ring 51*a* (sealing part 70*a*) and the turbine rotor 30, as illustrated in FIG. 2. The leakage steam 101 does not flow through the stationary blades 52*a*, so that the leakage steam 101 on which the predetermined change in the direction is not performed is directly jetted from a portion between the diaphragm inner ring 51*a* and the implant parts 42*a* of the rotor blades 40*a* into the steam 100. Accordingly, the flow of leakage steam 101 interferes with the flow of steam 100, which generates a loss (referred to as interference loss, hereinafter). At this time, the whole amount of the leakage steam 101 is jetted into the steam 100.

Generally, a flow rate g of the leakage steam 101 is represented by a function of flow coefficient C, steam density ρ, annular leakage area A and stationary blade pressure ratio P1/P2, as represented by an equation (1). The flow coefficient C is also represented by a function of the stationary blade pressure ratio P1/P2. Here, the annular leakage area A is a cross-sectional area of annular gap 110 formed between a seal fin of the sealing part 70*a* and the turbine rotor 30.

$$g=f(C,\rho,A,P1/P2) \qquad \text{equation (1)}$$

Here, the flow rate g of the leakage steam 101 is set by assuming that the stationary blade pressure ratio P1/P2 and the annular leakage area A in the respective turbine stages are equal. In this case, as the steam proceeds to the downstream turbine stages, the pressure is lowered so that the steam density ρ is lowered, resulting in that the flow rate g of the leakage steam 101 is reduced. Specifically, as the steam proceeds to the downstream turbine stages, a ratio of the flow rate g of the leakage steam 101 to the total flow rate G of steam that flows through the turbine stage (g/G) is reduced. Note that the total flow rate G of steam includes the flow rate g of the leakage steam 101.

Figure 5:
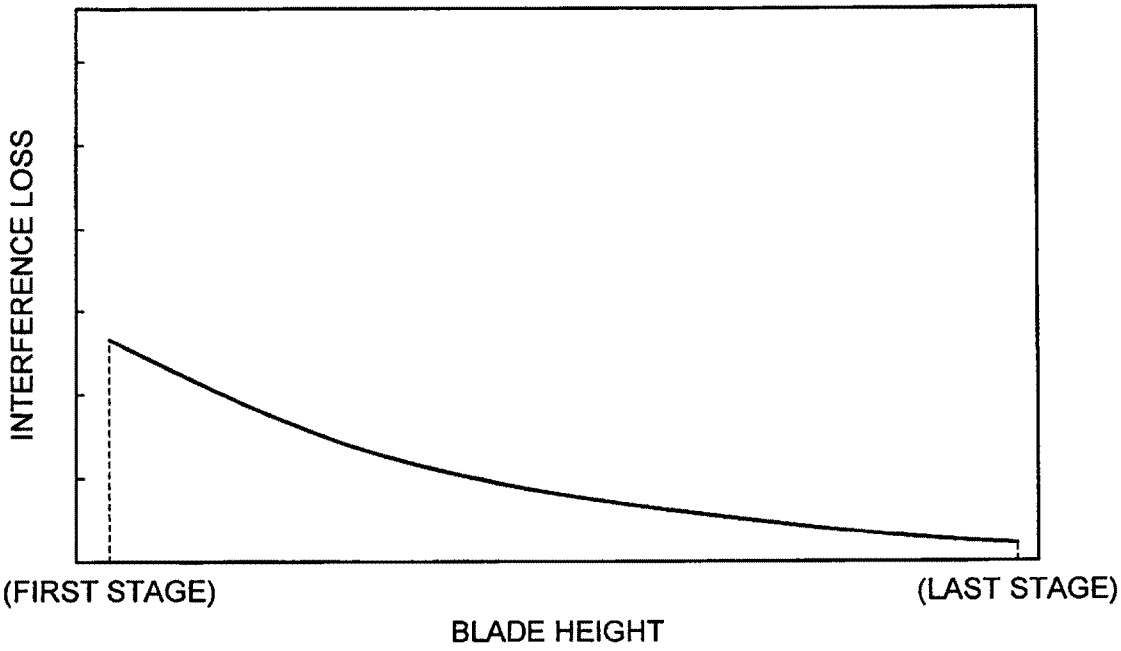
FIG. 5 is a view illustrating a relationship between an interference loss and a blade height of each rotor blade in turbine stages each including no steam passage of the steam turbine of the first embodiment.

FIG. 5 is a view illustrating a relationship between an interference loss and a blade height of each rotor blade in turbine stages each including no steam passage 60 of the steam turbine 10 of the first embodiment. Note that the blade height of each rotor blade on a horizontal axis is a blade height of each rotor blade in each turbine stage including no steam passage 60, and is a blade height in a blade effective part which does not include a tip shroud part and the implant part 42*a* (refer to FIG. 2). Here, the interference loss from a turbine stage of first stage to the turbine stage 90*a* (described as last stage in FIG. 5) is presented. Note that the result presented in FIG. 5 is obtained by a numerical analysis.

As illustrated in FIG. 5, in the turbine stage located at further downstream in which the blade height becomes high, the g/G is further lowered, and thus the interference loss is generally further reduced.

Figure 6:
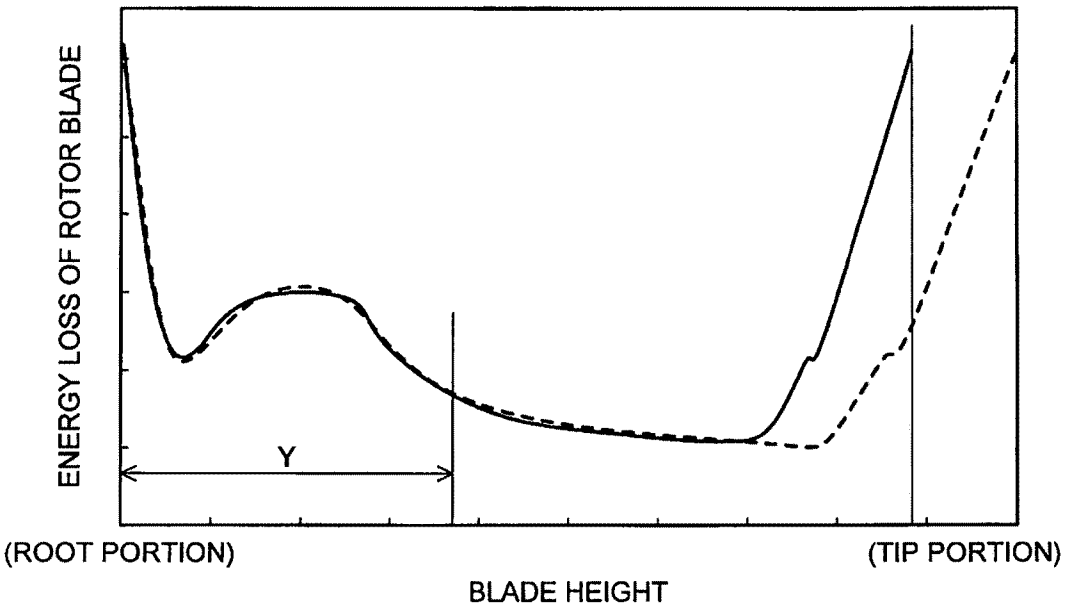
FIG. 6 is a view illustrating a distribution of energy loss of rotor blade in a blade height direction of each rotor blade in the turbine stage including no steam passage of the steam turbine of the first embodiment.

FIG. 6 is a view illustrating a distribution of energy loss of rotor blade in the blade height direction of each rotor blade in the turbine stage including no steam passage 60 of the steam turbine 10 of the first embodiment. FIG. 6 illustrates a distribution of energy loss of rotor blade regarding each of the same type of rotor blades with two types of blade heights. The blade height of each rotor blade in the result indicated by a dotted line is higher than the blade height of each rotor blade in the result indicated by a solid line. Note that the results presented in FIG. 6 are obtained by a numerical analysis.

Figure 19:
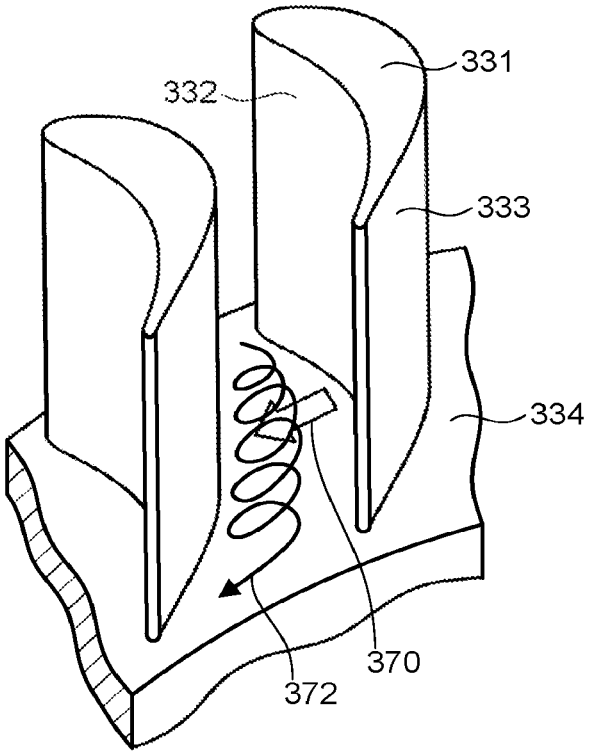
FIG. 19 Prior Art
FIG. 19 is a view schematically illustrating a secondary flow vortex generated on a blade root side of a rotor blade cascade in the conventional steam turbine.
Figure 20:
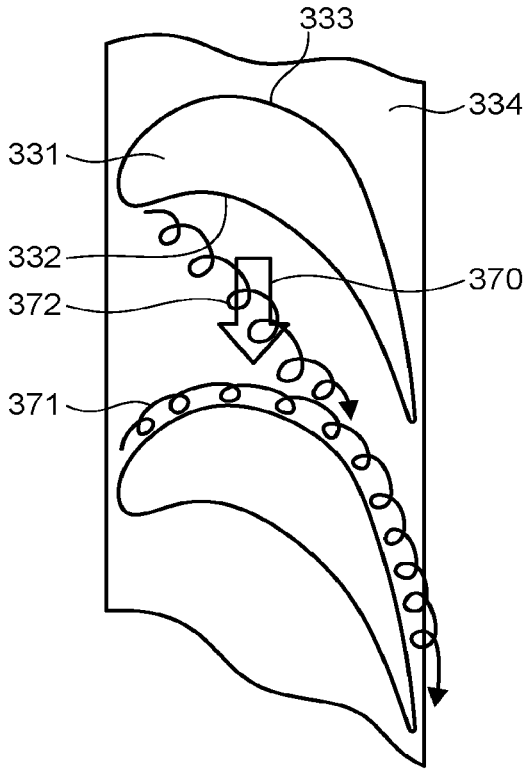
FIG. 20 Prior Art
FIG. 20 is a view schematically illustrating secondary flow vortices generated on a root side of rotor blades in the conventional steam turbine.

As illustrated in FIG. 6, on the root side of the rotor blade, there is generated a loss due to the secondary flow vortex (refer to FIG. 19 and FIG. 20). A range occupied by the secondary flow vortex is indicated by an approximately steady value Y regardless of the blade height in the blade height direction of each rotor blade.

Here, since the whole amount of the leakage steam 101 is jetted into the steam 100 as described above, the flow rate of steam that passes through the rotor blades is increased, when compared to a case where the steam passage 60 is provided. For this reason, it is possible to increase the blade height of each rotor blade in response to the increase in the flow rate of the steam. In the present embodiment, the blade height of each rotor blade is increased in response to the fact that the flow rate is increased by the amount of the leakage steam 101 in the turbine stage 90*a* including no steam passage 60.

Figure 7:
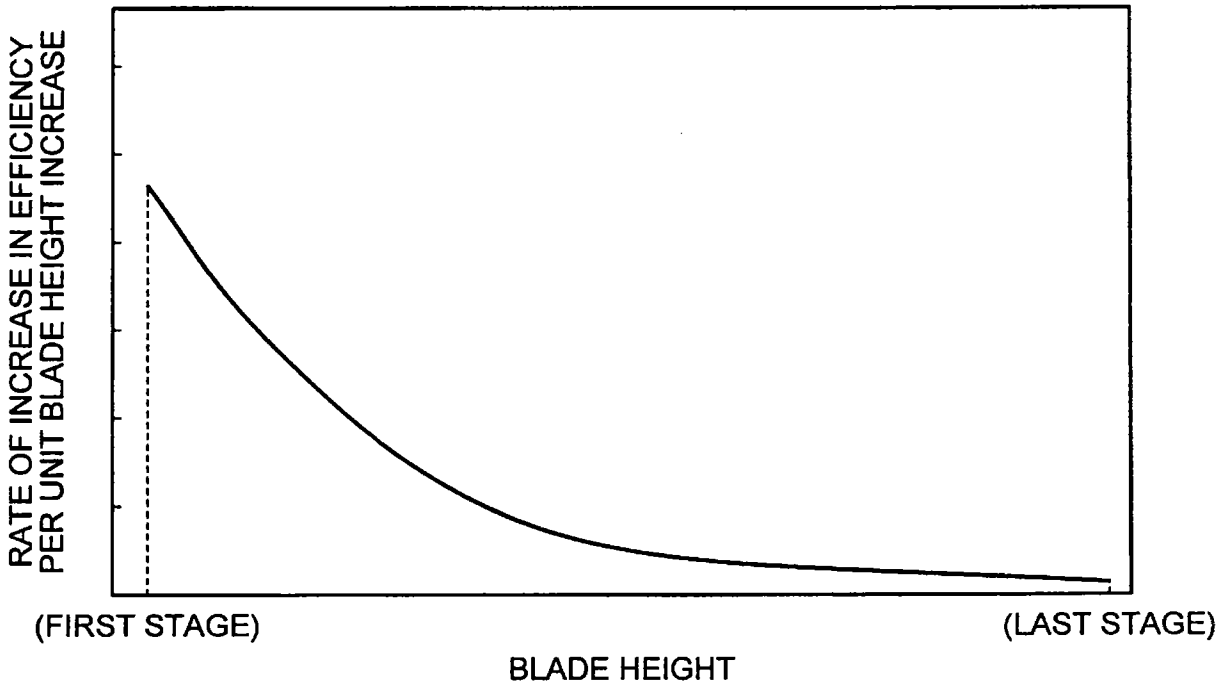
FIG. 7 is a view illustrating an efficiency increased in accordance with an increase in the blade height of each rotor blade in the turbine stages each including no steam passage of the steam turbine of the first embodiment.

FIG. 7 is a view illustrating an efficiency increased in accordance with the increase in the blade height of each rotor blade in the turbine stages each including no steam passage 60 of the steam turbine 10 of the first embodiment. Note that the blade height of each rotor blade on a horizontal axis is a blade height of each rotor blade in each turbine stage including no steam passage 60. A rate of increase in efficiency per unit blade height increase on a vertical axis is obtained by dividing an amount of increase in efficiency obtained based on an amount of increase in the flow rate of steam that passes through the rotor blades caused by the jet of the leakage steam 101, by an amount of increase in blade height (mm).

Here, the result from the turbine stage of first stage to the turbine stage 90*a* (described as last stage in FIG. 7) is presented. Note that the result presented in FIG. 7 is obtained by a numerical analysis.

As the blade height of each rotor blade becomes higher, a proportion of secondary flow vortex with respect to the blade height is reduced, so that the reduction of efficiency caused by the secondary flow vortex is suppressed. Specifically, as illustrated in FIG. 7, as the blade height of each rotor blade becomes higher, it becomes difficult to obtain a benefit brought by an increase in a blade length, namely, it becomes difficult for the turbine stage located at further downstream to obtain the benefit brought by the increase in the blade length.

Figure 8:
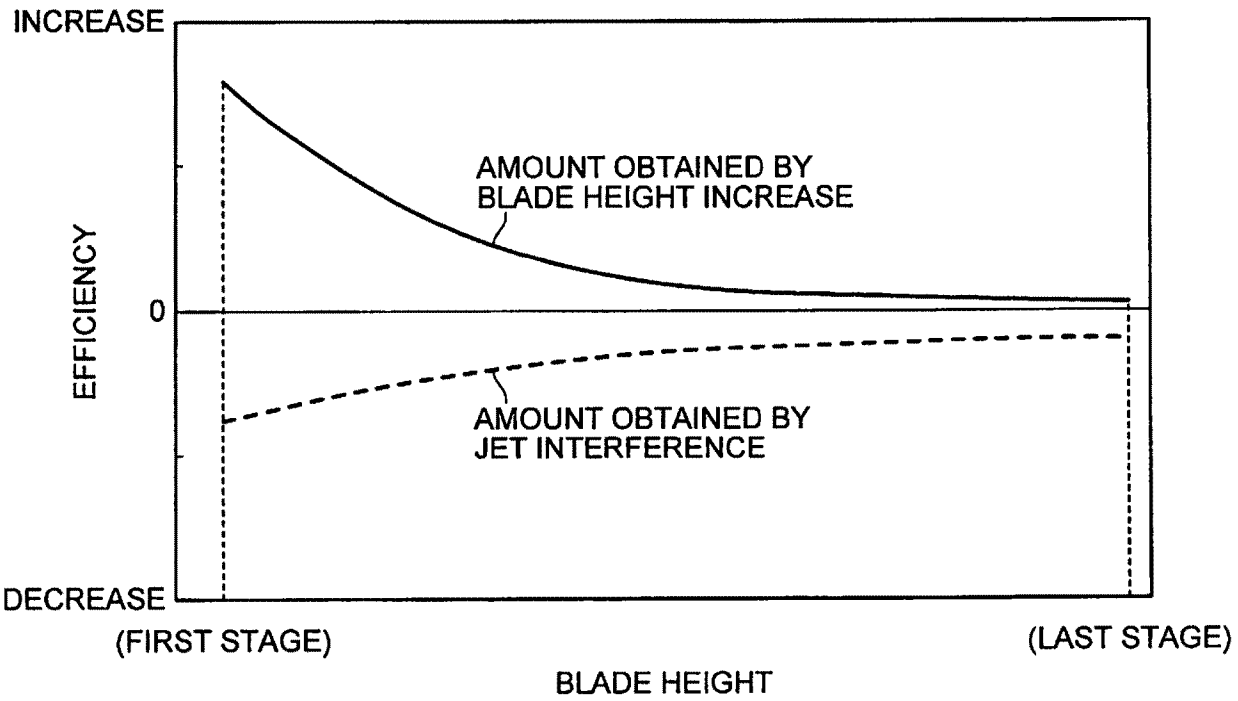
FIG. 8 is a view illustrating the efficiency increased in accordance with the increase in the blade height of each rotor blade and the interference loss in the turbine stages each including no steam passage of the steam turbine of the first embodiment.

FIG. 8 is a view illustrating the efficiency increased in accordance with the increase in the blade height of each rotor blade and the interference loss in the turbine stages each including no steam passage 60 of the steam turbine 10 of the first embodiment. Here, a result from the turbine stage of first stage to the turbine stage 90*a* (described as last stage in FIG. 8) is presented. The result presented in FIG. 8 is obtained by a numerical analysis. As illustrated in FIG. 8, it can be understood that the efficiency is determined by a subtraction of the efficiency increased in accordance with the increase in the blade height of each rotor blade and the interference loss.

Figure 9:
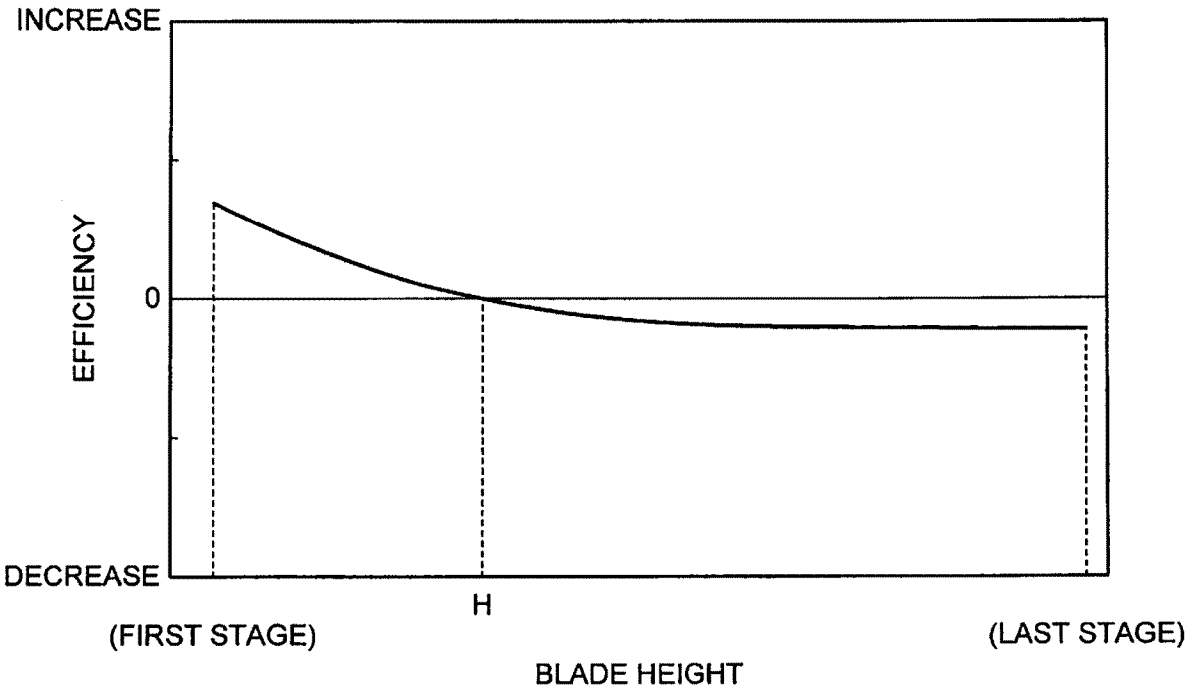
FIG. 9 is a view illustrating a difference between the efficiency increased in accordance with the increase in the blade height of each rotor blade and the interference loss in the turbine stages each including no steam passage of the steam turbine of the first embodiment.

FIG. 9 is a view illustrating a difference between the efficiency increased in accordance with the increase in the blade height of each rotor blade and the interference loss in the turbine stages each including no steam passage 60 of the steam turbine 10 of the first embodiment. The result presented in FIG. 9 is based on the result presented in FIG. 8.

As illustrated in FIG. 9, it can be understood that in the turbine stage including rotor blades each having a blade height lower than a blade height H at which the difference becomes 0, the performance is improved since no steam passage 60 is provided.

From the above description, the following findings regarding the boundary between the turbine stage 90*a* including no steam passage 60 and the turbine stage 90*b* including the steam passage 60, are obtained.

It is preferable that the steam passage 60 is not formed on a turbine stage including rotor blades each having a blade height lower than the blade height H at which the interference loss and the benefit brought by increasing the blade height of each rotor blade (efficiency increased in accordance with the increase in the blade height of each rotor blade) are cancelled. Here, the description in which the interference loss and the benefit brought by increasing the blade height of each rotor blade are cancelled means that a subtraction between the interference loss and the benefit brought by increasing the blade height of each rotor blade becomes 0.

In other words, the steam passage 60 is preferably formed on a turbine stage including rotor blades each having a blade height equal to or more than the blade height H at which the interference loss and the benefit brought by increasing the blade height of each rotor blade are cancelled.

Here, a threshold value of the blade height H is changed depending on a variation of various design parameters. Main causes thereof will be described hereinafter.

The flow rate g of the leakage steam 101 is changed depending on a shape of flow path through which the leakage steam 101 flows and the stationary blade pressure ratio P1/P2. For this reason, in the turbine stage 90*a* including no steam passage 60 illustrated in FIG. 2, for example, it is not possible to uniquely determine the flow rate of the leakage steam 101 jetted into the steam 100 and the amount of increase in the blade height of each rotor blade in accordance with the flow rate.

It can be considered that the higher a degree of reaction, the smaller the interference loss when the leakage steam 101 is jetted. Here, the degree of reaction corresponds to a proportion of rotor blade pressure ratio P2/P3 with respect to a stage pressure ratio P1/P3. Specifically, when the degree of reaction is high, the proportion of rotor blade pressure ratio becomes large.

By making a cross-sectional area of flow path when the steam flows out of the rotor blades 40*a* to be smaller than a cross-sectional area of flow path when the steam flows into the rotor blades 40*a*, the pressure of the steam 100 is reduced while accelerating the steam 100. Specifically, even if the leakage steam 101 which is not normally accelerated and whose direction is not normally changed between the stationary blades 52*a*, is jetted from an upstream side of roots of the rotor blades 40*a*, as the degree of reaction becomes higher, the leakage steam 101 reduces its pressure and is accelerated in the rotor blades 40*a*. For this reason, a proportion of energy retrieved as a rotational force in the rotor blades 40*a* becomes high.

Here, there is conducted a study regarding the blade height of each rotor blade at which the interference loss and the benefit brought by increasing the blade height of each rotor blade (efficiency increased in accordance with the increase in the blade height of each rotor blade) are cancelled, while changing the degree of reaction under the flow rate of practical leakage steam 101 in the turbine stages each including no steam passage 60.

Figure 10:
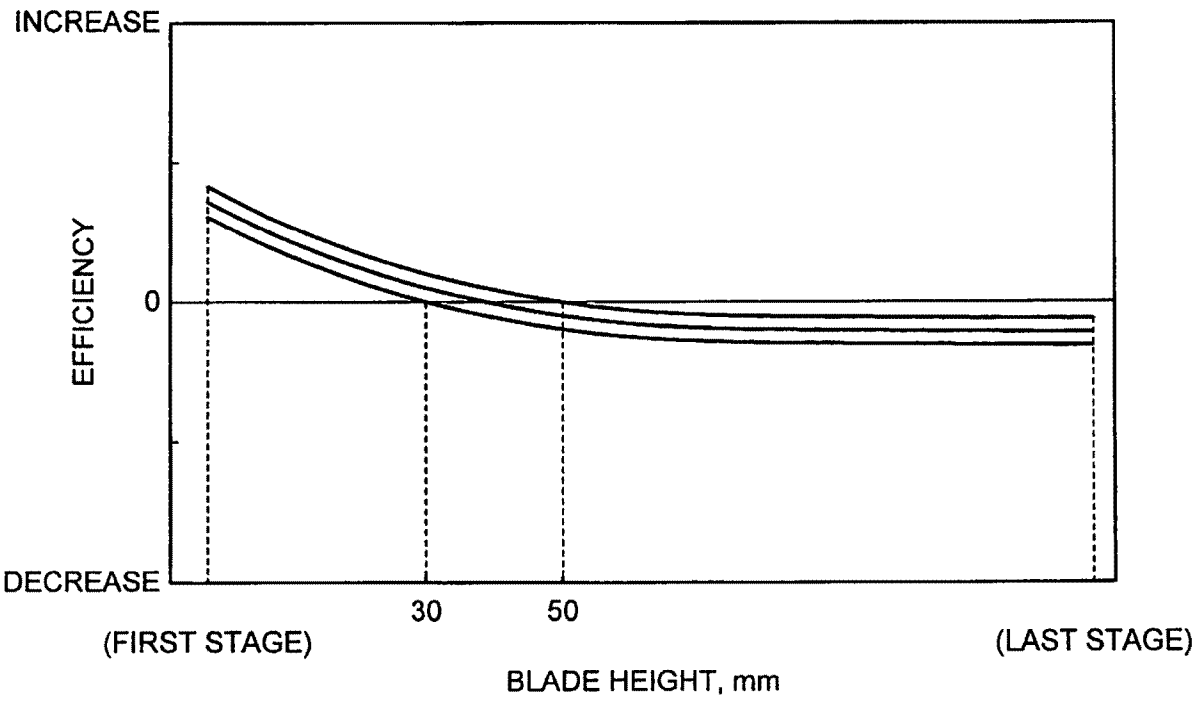
FIG. 10 is a view illustrating a difference between a benefit brought in accordance with the increase in the blade height of each rotor blade and the interference loss when a degree of reaction is changed under a flow rate of practical leakage steam in the turbine stages each including no steam passage of the steam turbine of the first embodiment.

FIG. 10 is a view illustrating a difference between the benefit brought in accordance with the increase in the blade height of each rotor blade and the interference loss when the degree of reaction is changed under the flow rate of practical leakage steam 101 in the turbine stages each including no steam passage 60 of the steam turbine 10 of the first embodiment. Note that among three lines indicating results illustrated in FIG. 10, the upper line indicates a condition with higher degree of reaction. The results presented in FIG. 10 are obtained by a numerical analysis.

As illustrated in FIG. 10, it is understood that as the degree of reaction becomes higher, the improvement of performance even in a range where the blade height is high can be achieved since the interference loss is suppressed. From the results presented in FIG. 10, the threshold value of the blade height at which the interference loss and the benefit brought by increasing the blade height of each rotor blade are cancelled, falls within a range of 30 mm to 50 mm, although it varies depending on the degree of reaction. Specifically, the steam passage 60 is preferably formed on the turbine stage in which the blade height of each rotor blade becomes 30 mm or more.

Here, as a steam turbine including rotor blades each having a low blade height such as a blade height of rotor blade of lower than 30 mm, there can be cited, for example, a high-pressure turbine to which high-pressure and high-density steam is supplied, or the like. Further, as the steam turbine, there can be cited a high-pressure turbine applied to a combined cycle and to which a steam with small flow rate generated by exhaust gas in a gas turbine is supplied, or the like. Concretely, the steam turbine 10 of the present embodiment can be applied to, for example, a high-pressure turbine applied to a high-efficiency combined cycle using natural gas in which $CO_2$ emission is smaller than that of coal and heavy oil.

Note that in this case, an example in which the configuration of the present embodiment is applied to the high-pressure turbine is shown, but, the present invention is not limited to these. The steam turbine 10 of the present embodiment can be applied to, for example, the steam turbine including the rotor blades each having the low blade height such as the blade height of lower than 30 mm as described above.

Next, an operation of the steam turbine 10 will be described with reference to FIG. 1.

The steam 100 that passes through the steam inlet pipe 80 and flows into the nozzle box 81 is jetted toward the rotor blades 40 from the stationary blades 52 provided at the outlet of the nozzle box 81.

In the turbine stage including no steam passage 60, the leakage steam 101 whose flow is divided from the steam 100 passes through the gap 110 between the diaphragm inner ring 51 (sealing part 70) and the turbine rotor 30. Further, the whole amount of the leakage steam 101 is jetted into the steam 100 being the main flow, from a portion between the diaphragm inner ring 51 and the rotor blades 40.

The leakage steam 101 jetted into the steam 100 interferes with the flow of the steam 100, and flows into portions between the rotor blades 40 together with the steam 100. The turbine rotor 30 is rotated with a rotational force given by the steam 100 and the leakage steam 101 flown into the portions between the rotor blades 40.

Meanwhile, in the turbine stage including the steam passage 60, the leakage steam 101 whose flow is divided from the steam 100 passes through the gap 110 between the diaphragm inner ring 51 (sealing part 70) and the turbine rotor 30. Further, a large portion of the leakage steam 101 passes through the steam passage 60, and flows out to a portion between the rotor blades 40 or the rotor disk 31 and the diaphragm inner ring 51 in the turbine stage on the downstream side. The remaining leakage steam 101 is jetted into the steam 100 from a portion between the diaphragm inner ring 51 and the rotor blades 40.

Note that since the large portion of the leakage steam 101 passes through the steam passage 60, a differential pressure in front of and at the rear of the rotor blades 40 becomes small. Accordingly, a force applied to the thrust bearing also becomes small, so that the diameter of the thrust bearing can be reduced.

The leakage steam 101 jetted into the steam 100 interferes with the flow of the steam 100, and flows into portions between the rotor blades 40 together with the steam 100. In this case, since the flow rate of the leakage steam 101 jetted into the steam 100 is small, the interference loss is small. Further, the turbine rotor 30 is rotated with a rotational force given by the steam 100 and the leakage steam 101 flown into the portions between the rotor blades 40.

The steam 100 (including the leakage steam 101) passed through a turbine stage of final stage passes through an exhaust passage (not illustrated) to be exhausted to the outside of the steam turbine 10.

As described above, according to the steam turbine 10 of the first embodiment, since there are provided the turbine stages each including no steam passage 60 and the turbine stages each including the steam passage 60, it is possible to reduce the loss caused in accordance with the flow of steam and to realize the improvement of efficiency.

Figure 11:
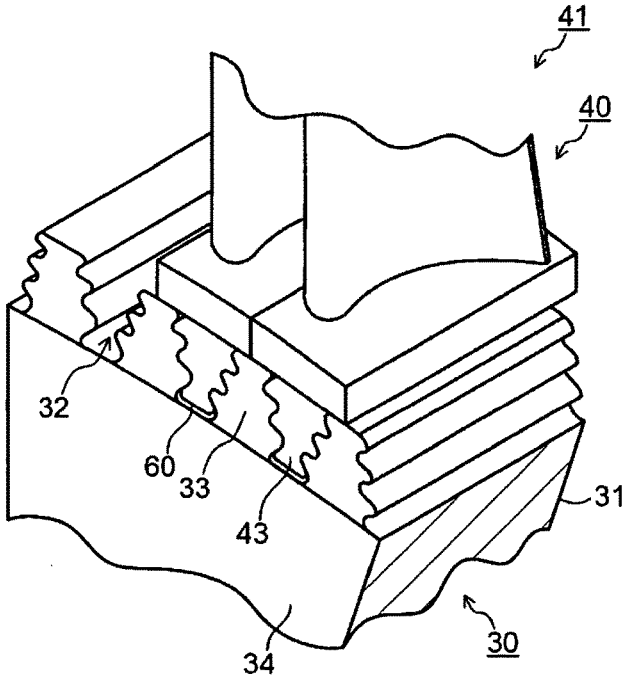
FIG. 11 is a perspective view illustrating a part of rotor blade cascade of a turbine stage including a steam passage in the steam turbine of the first embodiment.
Figure 12:
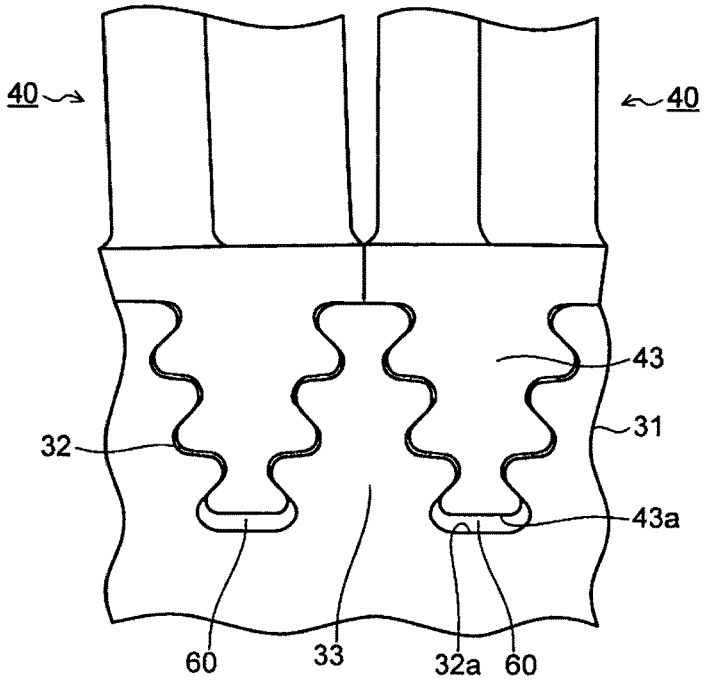
FIG. 12 is a plan view when a state where the rotor blades of the steam turbine of the first embodiment are implanted in implanting grooves is seen from an upstream side of a turbine rotor axial direction.

Here, in the steam turbine 10 of the first embodiment described above, the rotor blades 40 implanted in the rotor disk 31 by being inserted from the circumferential direction are exemplified, but, the configuration of the rotor blades 40 is not limited to this. FIG. 11 is a perspective view illustrating a part of the rotor blade cascade 41 of the turbine stage including the steam passage 60 in the steam turbine 10 of the first embodiment. FIG. 12 is a plan view when a state in which the rotor blades 40 of the steam turbine 10 of the first embodiment are implanted in implanting grooves 32, is seen from an upstream side of the turbine rotor axial direction.

As illustrated in FIG. 11 and FIG. 12, the rotor blades 40 may also be rotor blades of so-called axially-inserted blade root type in which they are inserted in the turbine rotor axial direction. The rotor disk 31 of the turbine rotor 30 includes blade wheels 33 configured by forming a plurality of implanting grooves 32 along the turbine rotor axial direction in the circumferential direction.

In concave implanting grooves 32 between the blade wheels 33, the rotor blades 40 are inserted from the upstream side of the turbine rotor axial direction. The rotor blade cascade 41 is configured by the plurality of rotor blades 40 implanted in the implanting grooves 32 formed in the circumferential direction.

The implant part 43 has a fitting concavo-convex shape, and the concavo-convex shape corresponds to a shape of the implanting groove 32 of the rotor disk 31. The fitting concavo-convex shape prevents the rotor blade 40 from coming out of the rotor disk 31 to the outside in the radial direction.

Further, on a downstream end of the blade wheel 33, there is provided a projecting portion (not illustrated) projecting to the implanting groove 32 side and preventing the implant part 43 of the rotor blade 40 from coming out to the downstream side, for example. For this reason, even when a load to the downstream side is applied to the rotor blade 40, the rotor blade 40 does not come out of the implanting groove 32.

As illustrated in FIG. 11 and FIG. 12, there is formed the steam passage 60 penetrating from the upstream side to the downstream side, between an inside diameter side end face 43*a* of the implant part 43 and a bottom face 32*a* of the implanting groove 32, for example. With the use of the steam passage 60, the leakage steam flown downstream between the diaphragm inner ring 51 and the turbine rotor 30 is led from the upstream side to the downstream side of the rotor disk 31.

Here, in the turbine stage including no steam passage 60, no gap is formed between the inside diameter side end face 43*a* of the implant part 43 and the bottom face 32*a* of the implanting groove 32. Further, when the gap between the inside diameter side end face 43*a* of the implant part 43 and the bottom face 32*a* of the implanting groove 32 is formed in the turbine stage including no steam passage 60, the gap is sealed.

Note that the steam passage 60 is not limited to the above, and it may also be configured by a through hole formed on the rotor disk 31, for example.

Second Embodiment

Figure 13:
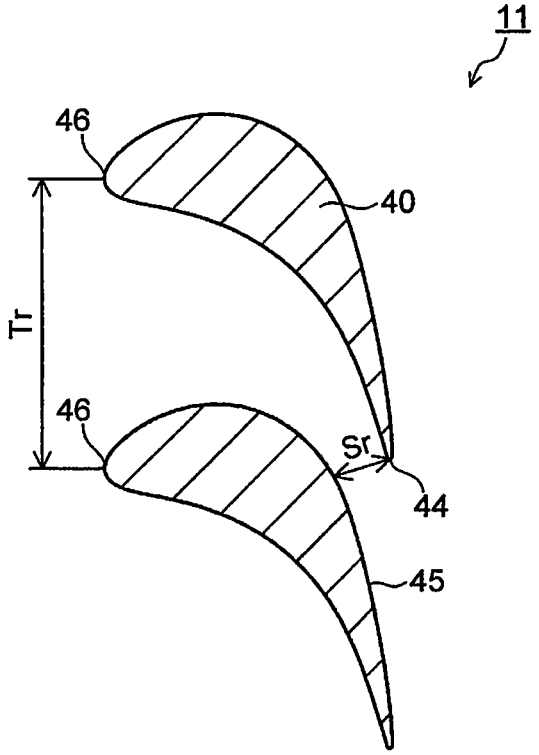
FIG. 13 is a view illustrating a cross section perpendicular to a blade height direction, at a predetermined blade height of each of rotor blades arranged in a circumferential direction in a steam turbine of a second embodiment.

FIG. 13 is a view illustrating a cross section perpendicular to a blade height direction, at a predetermined blade height of each of rotor blades 40 arranged in a circumferential direction in a steam turbine 11 of a second embodiment.

A configuration of the steam turbine 11 of the second embodiment is the same as that of the steam turbine 10 of the first embodiment except for a configuration of arrangement in the circumferential direction of the rotor blades 40. Accordingly, the configuration of arrangement in the circumferential direction of the rotor blades 40 will be mainly described here.

As illustrated in FIG. 13, a shortest distance between a trailing edge 44 of the rotor blade 40 and a suction-side face 45 of the rotor blade 40 adjacent to the rotor blade 40 is set to Sr. Further, an annular pitch of leading edges 46 of the rotor blades 40, between the adjacent rotor blades 40, is set to Tr.

Figure 14:
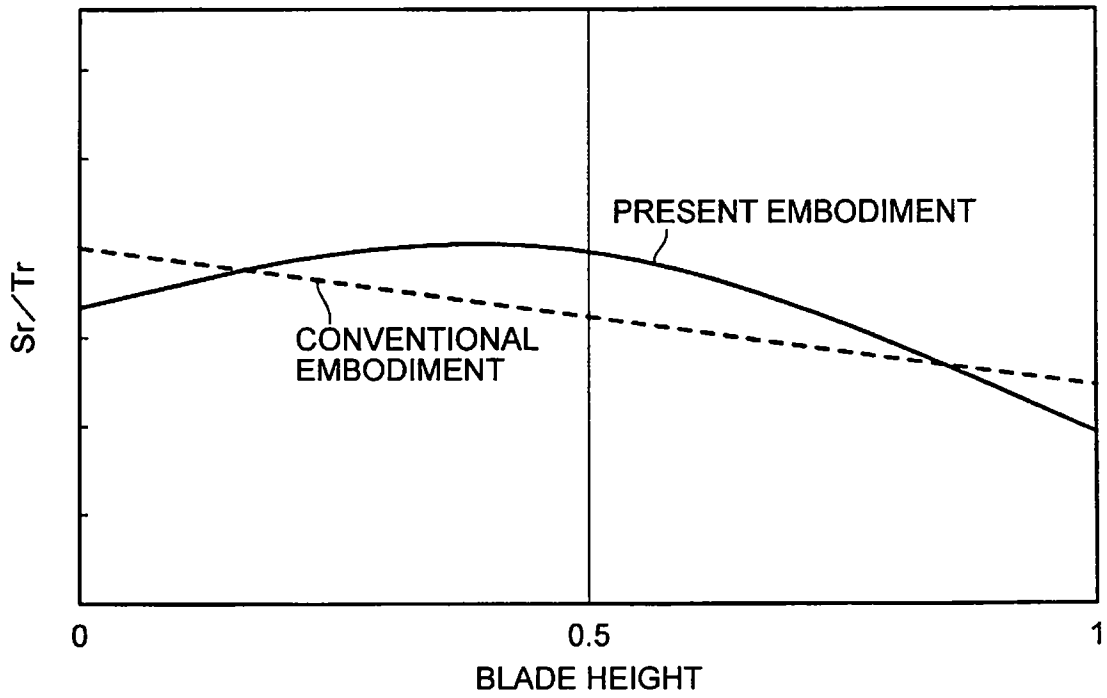
FIG. 14 is a view illustrating a change in the blade height direction of (Sr/Tr) in the rotor blades of the steam turbine of the second embodiment.

FIG. 14 is a view illustrating a change in the blade height direction of (Sr/Tr) in the rotor blades 40 of the steam turbine 11 of the second embodiment. Note that for the comparison, FIG. 14 also illustrates a change in a blade height direction of (Sr/Tr) in rotor blades of a conventional steam turbine. On a horizontal axis of FIG. 14, a root of a blade effective part of the rotor blade is set to 0, and a tip of the blade effective part of the rotor blade is set to 1.

As illustrated in FIG. 14, each rotor blade 40 of the steam turbine 11 of the second embodiment is configured in a manner that a ratio (Sr/Tr) between Sr and Tr becomes maximum at a center in the blade height. By configuring the rotor blade 40 as above, it is possible to increase a flow rate of steam that flows through a center portion in the blade height which is difficult to be affected by the secondary flow vortex. Specifically, by configuring the rotor blade 40 as above, a pressure ratio at an inlet of the rotor blades 40 and at an outlet of the rotor blades 40 is adjusted in the blade height direction.

Accordingly, it is possible to control a distribution of degree of reaction in the blade height direction. By locally increasing the degree of reaction on the root side of the rotor blades 40, it is possible to suppress the interference loss. For this reason, the efficiency can be improved even if a turbine stage including no steam passage 60 is extended to a turbine stage with higher blade height of each rotor blade.

Here, the configuration of the rotor blade 40 described above can also be applied to the stationary blade 52. Similar to the configuration illustrated in FIG. 13, a shortest distance between a trailing edge of the stationary blade 52 and a suction-side face of the stationary blade 52 adjacent to the stationary blade 52 is set to Ss. Further, an annular pitch of leading edges of the stationary blades 52, between the adjacent stationary blades 52, is set to Ts.

Figure 15:
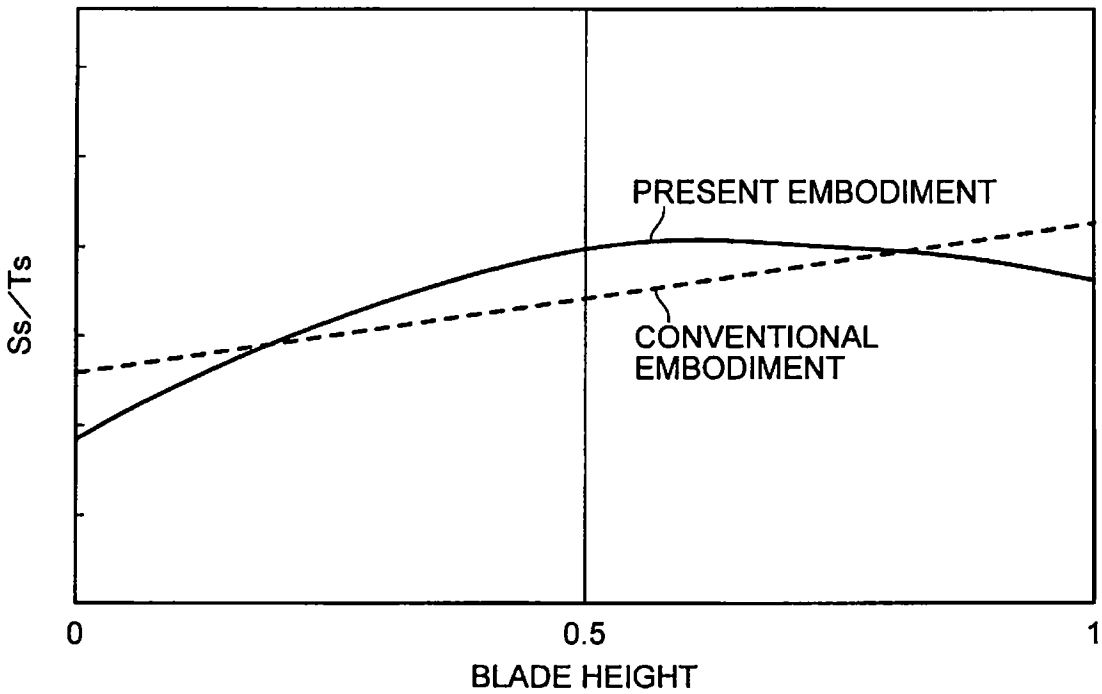
FIG. 15 is a view illustrating a change in a blade height direction of (Ss/Ts) in stationary blades of the steam turbine of the second embodiment.

FIG. 15 is a view illustrating a change in a blade height direction of (Ss/Ts) in the stationary blades 52 of the steam turbine 11 of the second embodiment. Note that for the comparison, FIG. 15 also illustrates a change in a blade height direction of (Ss/Ts) in stationary blades of a conventional steam turbine. On a horizontal axis of FIG. 15, a root of a blade effective part of the stationary blade is set to 0, and a tip of the blade effective part of the stationary blade is set to 1.

As illustrated in FIG. 15, each stationary blade 52 of the steam turbine 11 of the second embodiment is configured in a manner that a ratio (Ss/Ts) between Ss and Ts becomes maximum at a center in the blade height. Also in this case, a pressure ratio at an inlet of the stationary blades 52 and at an outlet of the stationary blades 52 can be adjusted in the blade height direction, similar to the rotor blades 40. Specifically, it is possible to control a distribution of degree of reaction in the blade height direction in the rotor blades 40 at an immediately downstream of the stationary blades 52.

Third Embodiment

Figure 16:
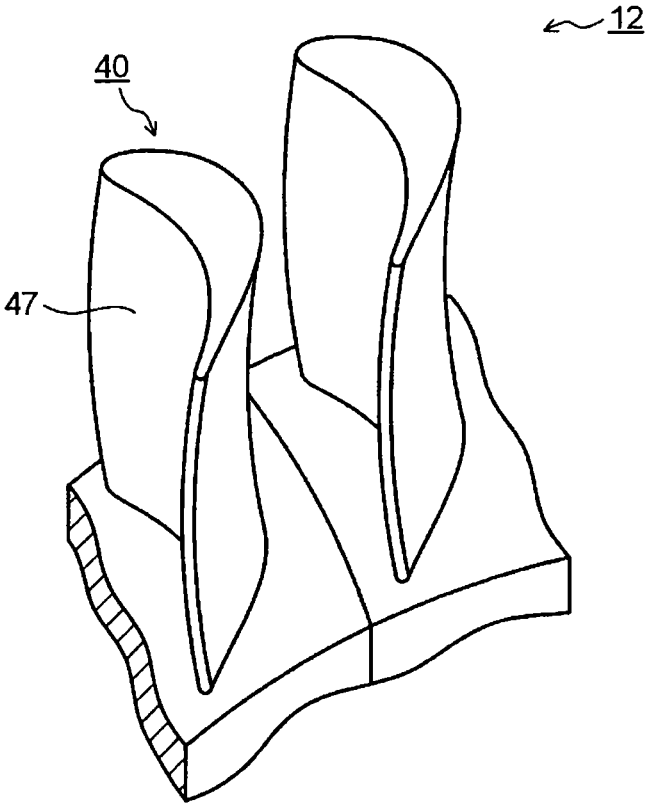
FIG. 16 is a perspective view when a part of rotor blades arranged in a circumferential direction in a steam turbine of a third embodiment is seen from a trailing edge side.
Figure 17:
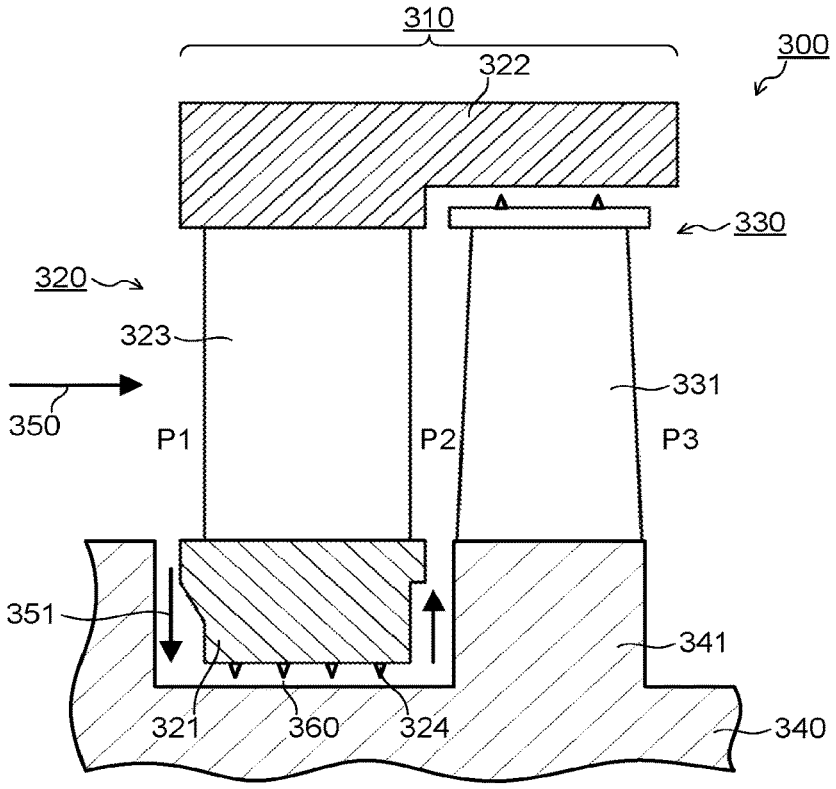
FIG. 17 Prior Art
FIG. 17 is a view illustrating a part of meridian cross section of a conventional steam turbine.
Figure 18:
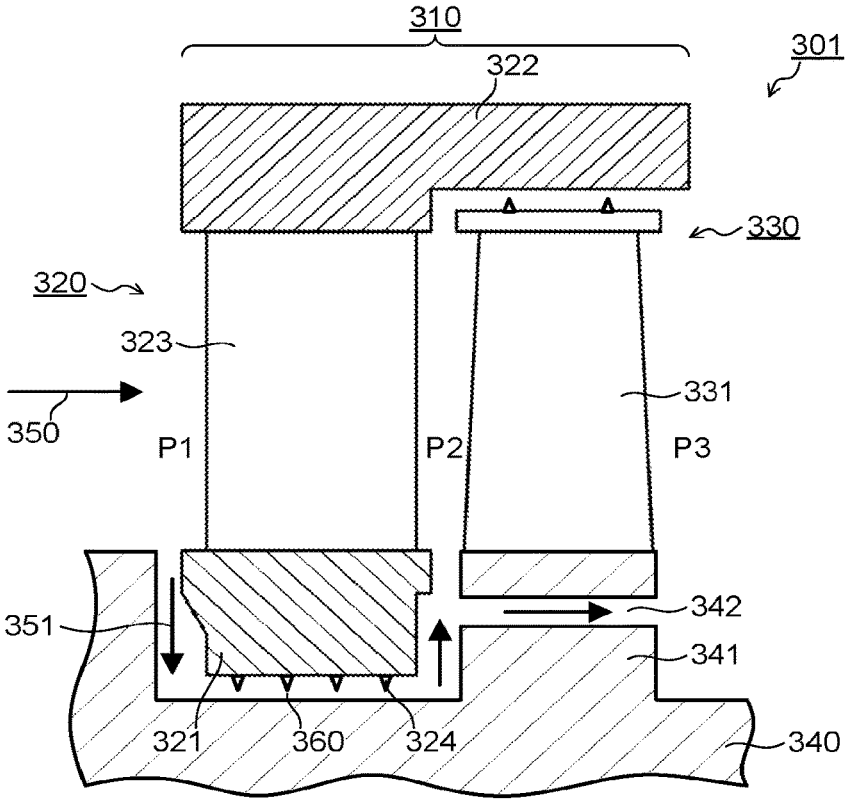
FIG. 18 Prior Art
FIG. 18 is a view illustrating a part of meridian cross section of a conventional steam turbine.

FIG. 16 is a perspective view when a part of rotor blades 40 arranged in a circumferential direction in a steam turbine 12 of a third embodiment is seen from a trailing edge side. Note that in this case, an illustration of configuration of tip portions of the rotor blades 40 is omitted.

A configuration of the steam turbine 12 of the third embodiment is the same as that of the steam turbine 10 of the first embodiment except for a shape of the rotor blade 40. Accordingly, the shape of the rotor blade 40 will be mainly described here.

As illustrated in FIG. 16, the rotor blade 40 is curved so that a pressure side 47 projects in the circumferential direction. As above, the rotor blade 40 is configured to have a so-called lean shape. For example, the rotor blade 40 may also be configured in a manner that a center in the blade height direction projects the most in the circumferential direction.

By curving the rotor blade 40 as above, it is possible to intentionally control the distribution of pressure in the blade height direction. For example, in the rotor blade 40 curved so as to make the center portion in the blade height project toward the suction side 47, it is possible to intentionally generate a velocity in a radial direction directed from the center of blade to the root side and the tip side. Accordingly, a force that presses the flow of steam, against an annular wall surface side on the root side at which a curling of secondary flow is strong due to the operation of centrifugal force, in particular is obtained. For this reason, it is possible to suppress the development of secondary flow vortex.

Specifically, a pressure P3 at an outlet of the rotor blades 40 is locally lowered on the root side to increase a rotor blade pressure ratio (P2/P3) between a pressure P2 at an inlet of the rotor blades 40 and the pressure P3 at the outlet of the rotor blades 40, thereby increasing the degree of reaction on the roots of the rotor blades 40. Accordingly, it is possible to control the distribution of degree of reaction in the blade height direction in the rotor blades 40.

Here, the configuration of the rotor blade 40 described above can also be applied to the stationary blade 52. Similar to the configuration illustrated in FIG. 16, the stationary blade 52 may also be configured to be curved so that a suction side projects in the circumferential direction. As above, the stationary blade 52 can be configured to have a so-called lean shape. For example, the stationary blade 52 may also be configured in a manner that a center in the blade height direction projects the most in the circumferential direction.

By curving the stationary blade 52 as above, it is possible to intentionally control the distribution of pressure in the blade height direction, similar to the above-described rotor blade 40. For example, in the stationary blade 52 curved so as to make the center portion in the blade height project toward the suction side, it is possible to intentionally generate a velocity in a radial direction directed from the center of blade to the root side and the tip side. Accordingly, a force that presses the flow of steam against the diaphragm inner ring 51 side and the diaphragm outer ring 50 side can be controlled. For this reason, it is possible to change a distribution in the blade height direction of the pressure P2 at the inlet of the rotor blades 40.

Note that the steam turbine of the present embodiment can also be designed to have a configuration in which the configuration of the second embodiment is added to the configuration of the third embodiment.

According to the embodiments described above, it becomes possible to reduce the loss caused in accordance with the flow of steam, and to realize the improvement of efficiency.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A steam turbine, comprising:

a turbine rotor penetratingly provided in a casing, and having a plurality of stages of rotor disks projected to an outside in a radial direction along a circumferential direction, in a turbine rotor axial direction;

rotor blade cascades each provided in the rotor disks, the rotor blade cascades each having a plurality of rotor blades arranged in the circumferential direction;

stationary blade cascades each configured by supporting a plurality of stationary blades in the circumferential direction between a diaphragm outer ring and a diaphragm inner ring provided on an inside of the casing; and turbine stages each configured by arranging the stationary blade cascade and the rotor blade cascade alternately in the turbine rotor axial direction, the turbine stages including a first turbine stage, at least one turbine stage upstream from the first turbine stage, and at least one turbine stage downstream from the first turbine stage, wherein the first turbine stage of the plurality of turbine stages and each stage of the at least one turbine stage downstream of the first turbine stage include a respective steam passage configured to lead a leakage steam from an upstream side to a downstream side of the rotor disk, and each of the at least one turbine stage of the plurality of turbine stages upstream from the first turbine stage lacks the steam passage.

2. The steam turbine according to claim 1, wherein at least one of the steam passages is formed by a through hole formed on the rotor disk.

3. The steam turbine according to claim 1, wherein, in the rotor blades implanted in the rotor disk by being inserted from the circumferential direction, at least one of the steam passages is formed by a communication groove formed on at least either end face in the circumferential direction of each of implant parts of the rotor blades and extended from an upstream end to a downstream end of the implant parts.

4. The steam turbine according to claim 1, wherein, in the rotor blades implanted in the rotor disk by being inserted from the turbine rotor axial direction, at least one of the steam passages is formed by a gap between an inside diameter side end face of an implant part of the rotor blade and a bottom face of an implanting groove formed on the rotor disk and in which the implant part is implanted.

5. The steam turbine according to claim 1, wherein a ratio (Sr/Tr) becomes maximum at a center of a blade height of the rotor blade, where Sr is a shortest distance between a trailing edge of the rotor blade and a suction-side face of the rotor blade adjacent to the rotor blade and Tr is an annular pitch of leading edges of the rotor blades between the adjacent rotor blades.

6. The steam turbine according to claim 1, wherein a ratio (Ss/Ts) becomes maximum at a center of a blade height of the stationary blade, where Ss is a shortest distance between a trailing edge of the stationary blade and a suction-side face of the stationary blade adjacent to the stationary blade and Ts is the annular pitch of leading edges of the stationary blades between the adjacent stationary blades.

7. The steam turbine according to claim 1, wherein the rotor blade is curved to make a pressure side thereof project in the circumferential direction.

8. The steam turbine according to claim 1, wherein the stationary blade is curved to make a pressure side thereof project in the circumferential direction.

* * * * *